United States Patent [19]

Miyoshi et al.

[11] 4,420,737

[45] Dec. 13, 1983

[54] POTENTIALLY NON-LINEAR RESISTOR AND PROCESS FOR PRODUCING THE SAME

[75] Inventors: Tadahiko Miyoshi; Takeo Yamazaki; Kunihiro Maeda, all of Ibaraki, Japan

[73] Assignee: Hitachi, Ltd., Tokyo, Japan

[21] Appl. No.: 316,647

[22] Filed: Oct. 30, 1981

Related U.S. Application Data

[63] Continuation of Ser. No. 110,470, Jan. 8, 1980, abandoned.

[30] Foreign Application Priority Data

Jan. 16, 1979 [JP] Japan ..... 54-2203

[51] Int. Cl.[3] ..... H01C 7/12

[52] U.S. Cl. ..... 338/21; 29/610 R

[58] Field of Search ..... 338/21; 29/610 R; 252/518, 521

[56] References Cited

U.S. PATENT DOCUMENTS

| | | | |
|---|---|---|---|
| 4,031,498 | 6/1977 | Hayashi et al. | 338/21 |
| 4,319,215 | 3/1982 | Yamazaki et al. | 338/21 |
| 4,326,187 | 4/1982 | Miyoshi et al. | 338/21 |

FOREIGN PATENT DOCUMENTS 54-26710 9/1979 Japan .

*Primary Examiner*—C. L. Albritton

*Attorney, Agent, or Firm*—Antonelli, Terry & Wands

[57] ABSTRACT

A sintered product composed chiefly of zinc oxide. A paste composed of a glass powder, an organic binder and tin oxide having a catalytic activity for promoting the combustion of organic binder, is coated on the side surfaces of the sintered product. The paste coated on the sintered product is baked to remove by burning the organic binder in the paste. Then, electrodes are attached to the main surfaces of the sintered product to complete a non-linear resistor.

15 Claims, 3 Drawing Figures

POTENTIALLY NON-LINEAR RESISTOR AND PROCESS FOR PRODUCING THE SAME

This is a continuation of application Ser. No. 110,470, filed Jan. 8, 1980 abandoned.

BACKGROUND OF THE INVENTION

The present invention relates to a potentially nonlinear resistor composed of a sintered product which chiefly consists of zinc oxide, and to a process for producing the same.

In recent years, sintered products obtained by molding and calcining zinc oxide as a chief component, and bismuth oxide, manganese oxide, cobalt oxide, antimony oxide, and, as required, nickel oxide, chromium oxide, silicon oxide, boron oxide, lead oxide, magnesium oxide, aluminum oxide, and the like, as well as sintered products obtained by molding and calcining zinc oxide as a chief component, and lanthanum oxide, praseodymium oxide, samarium oxide, neodymium oxide, or cobalt oxide, manganese oxide, and the like, have been widely used as potentialy non-linear resistors in such fields as voltage stabilizer elements, surge absorbers, arresters and the like.

When the potentially non-linear resistor is used as a high-voltage surge absorber or arrester, the side surfaces thereof are usually covered with a glass layer in order to prevent the creeping flashover.

An arrester of this type has been disclosed, for example, in Japanese Patent Publication No. 26710/79. According to the potentially non-linear resistor disclosed in Japanese Patent Publication No. 26710/79, the glass layer for coating (1) must have strength against the heat cycle, (2) must have resistance against the humidity, and (3) must be easily handled. Therefore, a lead borosilicate glass having a coefficient of thermal expansion of 60 to $85\times10^{-7}$/C., or a zinc borosilicate glass having nearly the same coefficient of thermal expansion, or such glasses blended with titanium oxide, aluminum oxide or copper oxide, having been employed. Further, to cover the side surfaces of the resistor with the glass, the glass powder is blended with an organic binder to prepare a glass paste, the glass paste is adhered onto the side surfaces of the resistor and is heated at a temperature of about 400° to 650° C. in an oxidative atmosphere, such that the glass layer is baked.

With the resistor covered with the glass by such a conventional method, however, increased leakage current flows in a low-voltage region as compared with the resistors which are not coated with glass. Namely, the resistor coated with the glass according to the conventional method exhibits poor non-linear characteristics. Referring, for example, to a potentially non-linear resistor having a diameter of 50 mm and a thickness of 22 mm, the non-linearity coefficient $\alpha$ was 50 in a low-current region of 10 $\mu$A to 1 mA (current density of from $4\times10^{-7}$ to $4\times10^{-5}$ A/cm$^2$) before the resistor was coated with the glass. After the resistor was coated with the glass, however, the non-linearity coefficient $\alpha$ decreased to 20 or less. In practice, however, the potentially non-linear resistor must have the non-linearity coefficient $\alpha$ of greater than 30. For example, when applied to the arresters for protecting 1,200,000-volt transmission lines, the non-linearity coefficient $\alpha$ which is smaller than 30 permits a leakage current of greater than 80 $\mu$A to flow under a normal voltage ratio (normal operation voltage/voltage when a current of 1 mA is allowed to flow) of 95%. Namely, long life of 100 to 150 years required for the arresters cannot be expected.

SUMMARY OF THE INVENTION

The object of the present invention is to provide a potentially non-linear resistor which is coated with a glass and which exhibits excellent potentially non-linear characteristics, and a process for producing the same.

Another object of the present invention is to provide a potentially non-linear resistor having good insulation resistance, and a process for producing the same.

A further object of the present invention is to provide a potentially non-linear resistor having good resistance against the humidity, and a process for producing the same.

Still further object of the present invention is to provide a potentially non-linear resistor which precludes the occurrence of cracks in the glass layer from the heat cycle, and a process for producing the same.

According to the study conducted by the inventors of the present invention, it was learned that with the conventional potentially non-linear resistors of the type of zinc oxide coated with glass, the resistance was abnormally small on the interface between the glass layer and the sintered product and, hence, potentially non-linear characteristics were deteriorated being affected by a leakage current in those areas. It has heretofore been known that the resistance is decreased and the leakage current is increased if the resistor of the type of zinc oxide is heat-treated in an nitrogen gas at a temperature of higher than about 400° C. This phenomenon is attributed to that at a temperature of about 400° C. to 500° C. or higher, the organic binder in the glass paste undergoes the reaction with the sintered product of zinc oxide. Namely, as the organic binder burns consuming oxygen which is adsorbed on the surfaces of zinc oxide particles in the sintered product, the oxygen ions on the surfaces of the zinc oxide particles are reduced, and potential barriers on the grain boundaries of the sintered product or on the boundary layer are decreased, permitting the leakage current to increase.

Based upon the aforementioned discovery, the fundamental principle of the present invention consists of blending a catalyst into the glass paste in order to completely burn out the organic binder at a temperature of lower than about 400° C. at which the organic binder does not conspicuously react with zinc oxide. A variety of substances can be used as a catalyst. According to the present invention, however, tin oxide serves as an optimum catalyst because (1) it does not impair the insulation resistance of the glass, (2) it disperses very well in the glass and it permits the binder to burn homogeneously, and (3) it exhibits sufficient catalytic effects at a temperature of lower than about 400° C.

As will be mentioned later, when antimony oxide is contained in the sintered product, the tin oxide partly diffuses into the layer of zinc antimonate in the sintered product when the glass layer is being baked, enabling the glass layer and the sintered product to be intimately adhered together.

BRIEF DESCRIPTION OF THE DRAWINGS

FIG. 2 shows a partly cutaway side view of the potentially non-linear resistor according to the present invention which is provided a glass layer on the side with high-resistance intermediate layer between.

DESCRIPTION OF THE PREFERRED EMBODIMENT

Figure 1:
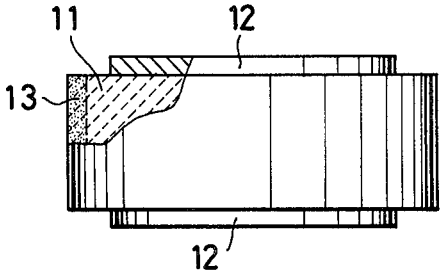
FIG. 1 shows a partly cutaway side view of the potentially non-linear resistor according to the present invention which is provided a glass layer on the side.

A potentially non-linear resistor to which is applied the present invention consists, as shown in FIG. 1, of a sintered product 11 comprising zinc oxide as a main component, and bismuth oxide, manganese oxide and cobalt oxide each in an amount of 0.01 to 10 mole %, and further comprising, as required, at least one of antimony oxide, nickel oxide, chromium oxide, silicon oxide, boron oxide, lead oxide, aluminum oxide, magnesium oxide and silver oxide each in an amount of 0.01 to 10 mole %, or a sintered product 11 comprising zinc oxide as a main component, and at least one of lanthanum oxide, praseodymium oxide, samarium oxide, neodymium oxide, dysprosium oxide and thulium oxide each in an amount of 0.01 to 10 mole %, and further at least either one of cobalt oxide or manganese oxide in an amount of 0.01 to 10 mole %.

Electrodes 12 are formed on the main surfaces of the sintered product 11. Reference numeral 13 denotes a glass layer formed on the side of the sintered product 11.

Figure 2:
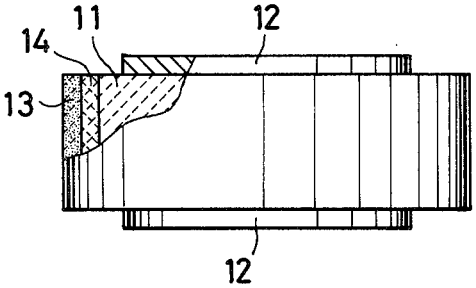

According to the present invention, furthermore, an intermediate layer 14 of a high resistance composed of zinc silicate and zinc antimonate is provided on at least the side surface of the sintered product 11 as shown in FIG. 2. If the glass layer 13 is coated via the intermediate layer 14, mutual diffusion takes place between the glass layer and the zinc silicate layer, and between the tin oxide and the zinc antimonate layer when the glass is being sintered, so that the glass layer and the sintered product are further intimately adhered together.

The aforementioned intermediate layer is usually formed by coating a paste composed of an oxide powder which is a raw material for the intermediate layer and an organic binder having a composition that will be mentioned later, on a molded product from which the resistor is to be prepared, and calcining the thus coated molded product at a temperature of about 1000° to 1300° C. Even in this step, therefore, it is considered that oxygen is removed from the zinc oxide on the surface of the molded product and is consumed by the burning of the organic binder. In this case, however, oxygen is consumed before the grain boundary layer which establishes potentially non-linear characteristics is formed, and affects little the non-linear characteristics. Besides, even if oxygen is consumed once, the non-linear characteristics are not impaired since oxygen is newly supplied from the external side owing to the movement of active substances during the sintering step. This is different from the baking of glass paste, which is effected after the grain boundary layer is formed, at a temperature of 700° C. to less than 800° C. by taking into consideration the coefficient of thermal expansion of the glass so that oxygen is less diffused. In other words, the consumption of oxygen during the formation of the intermediate layer affects little the non-linear characterlistics unlike the baking of glass paste.

According to the potentially non-linear resistor of the present invention as mentioned in the foregoing, at least the side surface of the resistor is coated with a layer of lead borosilicate glass containing tin oxide in a direct manner of via a high-resistance intermediate layer as diagramatized in FIGS. 1 and 2, in order to prevent the creeping flashover. Further, as required, the glass layer may be formed up to the main surfaces where the electrodes are provided.

The glass coating will contain 40 to 85% by weight of lead oxide, 3 to 25% by weight of boron oxide, and 1.5 to 25% by weight of silicon oxide. Preferably, the glass coating will contain 40 to 75% by weight of lead oxide, 5 to 15% by weight of boron oxide, and 2.5 to 25% by weight of silicon oxide. When the amounts of lead oxide and boron oxide are greater than the above-mentioned amounts, and when the amount of silicon oxide is smaller than the above-mentioned amount, the glass loses resistance against moisture. Therefore, the insulation resistance is decreased by the moisture contained in the air, or the coefficient of thermal expansion is increased, giving rise to the occurrence of cracks in the glass layer during the thermal cycle.

As the wet resistance characteristics, the glass components shall not elute out even when the glass layer is treated while being submerged in water, and the withstand voltage against the impulses shall not decrease. As the insulation resistance, the potentially non-linear resistor having, for example, a diameter of 56 mm and a thickness of 22 mm shall not lose the insulation resistance even when an impulse of $4\times 10$ μs (a peak current of 100 to 150 KA) is applied. In regard to the heat cycle, the potentially non-linear resistor shall not develop cracks even after it is subjected to 1000 cycles of heating, each cycle being heated at a temperature over a range of from −30° C. to 80° C. for 4 hours, and further shall not lose the resistance against the impulse.

When the amounts of lead oxide and boron oxides are too small, or when the amount of silicon oxide is too large, the glass exhibits small coefficient of thermal a expansion, develops cracks in the glass layer during the thermal cycles, and further must be baked at a temperature higher than 700° C., resulting in a disadvantage from the standpoint of the manufacturing steps required using an electric furnace. If the thickness of the glass layer is too small, it is difficult to completely eliminate the ruggedness over about 20 to 30 μm on the surface of the sintered product; i.e., the withstand voltage against impulse cannot be increased. Conversely, when the thickness of the glass layer is too great, cracks easily develop in the glass layer, causing the withstand voltage against impulse to be decreased. Therefore, with the composition of the present invention, the thickness of the glass layer should range from 30 μm to 1 mm.

According to the present invention, the tin oxide should be added to the glass having a fundamental composition as mentioned earlier in an amount of 0.4 to 10% by weight. If the amount of tin oxide is smaller than the above-mentioned value, the catalytic effect is not sufficiently exhibited. If the amount of tin oxide is too great, on the other hand, stress resulting from the difference between the coefficient of thermal expansion of tin oxide (about $45\times 10^{-7}$/C.) and the coefficient of thermal expansion of the sintered product of zinc oxide (about $70\times 10^{-7}$/C.) develops in the interface between the sintered product and the glass layer, causing the glass to be cracked during the thermal cycles, or giving rise to the occurrence of microcracks, which results in the decrease of insulation resistance and loss of characteristics of the potentially non-linear resistor.

According to the present invention, furthermore, the aforementioned glass may be crystallized being blended with zinc oxide in an amount of 4 to 30% by weight, and may further be blended with zirconium oxide as a filler in an amount of 5 to 30% by weight, such that the glass layer withstands the terminal cycle of a wide temperature range from about −30° C. which is the lowest temperature at which the resistor will be used to a baking temperature of the glass. When the amount of zinc oxide or zirconium oxide is smaller than the above value, sufficient effect is not exhibited to prevent the glass from being cracked. When the amount of zinc oxide or zirconium oxide is too great, on the other hand, the development of microcracks causes the insulation resistance of the glass layer to be decreased. In the case of the crystallized glass containing zinc oxide, tin oxide will work as a crystallization promoting agent. The glass may further contain small amounts of metal fluorides.

According to the present invention, the glass of lead borosilicate containing tin oxide is formed by coating required portions of the sintered product of zinc oxide with a paste of glass powder and organic binder by a customary manner, followed by baking. In this case, the organic binder works to bond the glass powder onto the sintered product. Suitably, therefore, the organic binder should be composed of a high molecular substance that will be completely burned at a temperature lower than the baking temperature of the glass. For example, ethyl cellulose, polyvinyl alcohol, polyethylene glycol and the like will be used in the form of a solution.

The invention is illustrated below by way of Working Examples. It should, however, be noted that the effects of the present invention are by no means restricted to those of the Examples, in which percent is all by weight.

EXAMPLE 1

To 785.5 g of ZnO were added 23.3 g of $Bi_2O_3$, 8.3 g of $Co_2O_3$, 5.8 g of $MnCO_3$, 29.2 g of $Sb_2O_3$, 7.6 g of $Cr_2O_3$, 7.5 g of NiO, 3.0 g of $SiO_2$, 0.8 g of $B_2O_3$, and 0.2 g of $Al(NO_3)_3$, and were mixed together for 10 hours using a ball mill. The above powdery raw material was blended with an aqueous solution containing 2% of polyvinyl alcohol in an amount of 10% with respect to the powdery raw material, and was molded to a size of 12 mm in diameter and 5 mm in thickness under a molding pressure of 750 kg/cm$^2$. The thus molded product was heated at a temperature raising rate of 100° C./h, and treated at 900° C. for 2 hours. An oxide paste obtained by kneading 112 g of $Bi_2O_3$, 175 g of $Sb_2O_3$, 130 g of $SiO_2$, 85 g of ethyl cellulose, 600 g of butyl carbitol and 150 g of butyl acetate, was then coated onto the side surface of the above molded product to a thickness of 100 to 200 μm. The resulting product was then heated at a temperature raising rate of 100° C./h, and calcined at 1200° C. for 5 hours. During the step of calcination, $Bi_2O_3$ in the oxide paste was evaporated, and $Sb_2O_3$ and $SiO_2$ were reacted with ZnO, respectively, to form a high-resistance intermediate layer 14 composed chiefly of $Zn_7Sb_2O_{12}$ and $Zn_2SiO_4$ on the side surface of the sintered product 11 as shown in FIG. 2.

The thus sintered element exhibited a non-linearity coefficient α of as excellent as about 50 at a current of 10 μA to 1 mA. The side surface of the element, however, was so rugged that it was easily contaminated during the handling. Besides, once contaminated, it was difficult to clean the sintered element. Therefore, the above sintered element easily developed creeping flashover in the impulse test.

Then, there were prepared 400 g of a glass powder containing 55% of PbO, 8% of $B_2O_3$, 3% of $SiO_2$, 25% of ZnO, 4% of $SnO_2$ and 5% of $ZrO_2$, and a glass paste consisting of 11 g of ethyl cellulose, 78 g of butyl carbitol and 30 g of butyl acetate. The glass paste was coated on the side surface of the above-mentioned element to a thickness of 100 to 200 μm via the high-resistance intermediate layer 14, and was heated at a temperature raising rate of 200° C./h and was treated at 530° C. for 10 minutes in the air, thereby to form a glass layer. Finally, the two main surfaces of the element were polished flat, and aluminum electrodes 12 were melt-adhered thereon, to obtain a resistor element having a construction as illustrated in FIG. 2.

The resistor element exhibited a non-linearity coefficient α of as great as 48 over a current range of 10 μA to 1 mA. Besides, the side surface of the element was smooth and was not easily contaminated while maintaining excellent wet-resistance characteristics. The element therefore exhibited an impulse withstand voltage of two or more times that of the element without the glass coating. Further, the glass layer intimately adhered onto the element, and did not peel off or develop cracks even after the element was subjected to the heat cycles 1000 times over a temperature range of −30° C. to 80° C. There was recognized no problem in regard to the element characteristics such as non-linearity coefficient.

COMPARATIVE EXAMPLE

Resistor elements having a glass coating on the side surface via a high-resistance intermediate layer were prepared in the same manner as in Example 1 with the exception of using the below-mentioned glasses A and B which did not contain tin oxide.

| | Glass composition: | |
|---|---|---|
| | A | B |
| PbO | 57.0% | 55.0% |
| $B_2O_3$ | 8.5 | 8.0 |
| $SiO_2$ | 3.2 | 3.0 |
| ZnO | 26.0 | 25.0 |
| $Al_2O_3$ | — | 4.0 |
| $ZrO_2$ | 5.3 | 5.0 |

In either elements, the glass coating permitted increased leakage current to flow at low voltages. The non-linearity coefficients α of the elements were as small as 25 in the case of the glass A and 22 in the case of the glass B.

EXAMPLE 2

To 785.3 g of ZnO were added 46.6 g of $Bi_2O_3$, 16.6 g of $Co_2O_3$, 5.8 g of $MnCO_3$, 29.2 g of $Sb_2O_3$, 7.6 g of $Cr_2O_3$, 9.0 g of $SiO_2$, 3.2 g of $B_2O_3$, 7.5 g of NiO and 0.1 g of $Al(NO_3)_3$, and were mixed, granulated, molded and treated with heat in the same procedures as those of Example 1. To the product was then coated an oxide paste followed by calcination, to obtain a sintered product having a size of 30 mm in diameter and 30 mm in thickness.

Then, pastes of glasses of the compositions shown in Table below were prepared in the same manner as in Example 1, coated onto the side surface of the sintered product via the high-resistance intermediate layer, and were baked at a temperature of 400° to 650° C. Thereafter, the electrodes were formed on the main surfaces. Characteristics of the thus prepared resistor elements were measured. The results were as shown in Table given below.

Judgement standards for the test of heat-resistance cycles:

X: Cracks are developed in the glass layer after the resistor element is baked but before it is cooled to room temperature.

Δ: The impulse withstand quantity is decreased after the resistor element is subjected to 1000 times of heat cycle of from −30° to 80° C. Before the heat cycle, no creeping flashover took place even when an impulse of 4×10 μS (a peak current of 50 KA) was applied, but after the heat cycle, creeping flashover took place when an impulse of 4×10 μS (a peak current of 30 to 40 KA) was applied.

O : No change in characteristics even after the resistor element is subjected to the test of heat cycles.

O : No crack developed when the resistor element is taken out from the electric furnace immediately after the glass layer is baked.

Judgement standards for the test of wet resistance characteristics:

X: Glass is eluted out or impulse withstand quantity is decreased when the resistor element is submerged in water.

Δ: Glass is eluted out or impulse withstand quantity is decreased when the resistor element is submerged in boiling water.

O : Impulse withstand quantity is not decreased even when the resistor element is submerged in boiling water.

The elements having a mark O in the wet resistance characteristics can be used under high-temperature and high-humidity conditions, and the elements having a mark Δ can be used being incorporated in the insulators such as of arresters.

TABLE

| No. | Glass composition (% by weight) PbO | $B_2O_3$ | $SiO_2$ | $SnO_2$ | ZnO | $ZrO_2$ | $Al_2O_3$ | Non-linearity coefficient α | Characteristics of heat-resistance cycles | Wet resistance characteristics |
|---|---|---|---|---|---|---|---|---|---|---|
| 1 | 65 | 10 | 20 | 0.24 | — | — | 4.76 | 22 | o | o |
| 2 | 65 | 10 | 20 | 0.4 | — | — | 4.6 | 35 | o | o |
| 3 | 65 | 10 | 20 | 5 | — | — | — | 51 | o | o |
| 4 | 65 | 10 | 15 | 10 | — | — | — | 50 | o | o |
| 5 | 60 | 10 | 15 | 15 | — | — | — | 48 | x | — |
| 6 | 35 | 20 | 35 | 10 | — | — | — | 46 | x | — |
| 7 | 40 | 15 | 20 | 10 | — | — | 15 | 46 | o | o |
| 8 | 85 | 3 | 11 | 1 | — | — | — | 44 | o | Δ |
| 9 | 90 | 3 | 5 | 2 | — | — | — | 48 | Δ | x |
| 10 | 60 | 10 | 25 | 5 | — | — | — | 51 | o | o |
| 11 | 60 | 5 | 30 | 5 | — | — | — | 42 | x | — |
| 12 | 65 | 10 | 1.5 | 5 | — | — | 18.5 | 53 | o | Δ |
| 13 | 65 | 10 | 0.5 | 5 | — | — | 19.5 | 48 | o | x |
| 14 | 55 | 30 | 5 | 8 | — | — | 2 | 45 | Δ | x |
| 15 | 65 | 25 | 5 | 5 | — | — | — | 47 | o | Δ |
| 16 | 65 | 3 | 20 | 5 | — | — | 7 | 52 | Δ | o |
| 17 | 65 | 1 | 25 | 5 | — | — | 4 | 50 | x | — |
| 18 | 75 | 5 | 15 | 5 | — | — | — | 49 | o | o |
| 19 | 57 | 9 | 5 | 3.5 | 25 | — | 0.5 | 51 | ◎ | o |
| 20 | 52 | 9 | 5 | 3.5 | 30 | — | 0.5 | 49 | ◎ | o |
| 21 | 32 | 9 | 5 | 3.5 | 50 | — | 0.5 | 47 | x | — |
| 22 | 60 | 10 | 22 | 4 | 4 | — | — | 45 | ◎ | o |
| 23 | 60 | 10 | 22 | 6 | 2 | — | — | 51 | o | o |
| 24 | 60 | 5 | 7 | 8 | 20 | — | — | 53 | ◎ | o |
| 25 | 60 | 10 | 20 | 5 | — | 5 | — | 44 | ◎ | o |
| 26 | 60 | 10 | 20 | 8 | — | 2 | — | 48 | o | o |
| 27 | 50 | 8 | 7 | 5 | — | 30 | — | 49 | ◎ | o |
| 28 | 45 | 5 | 8 | 2 | — | 40 | — | 43 | x | — |
| 29 | 60 | 10 | 5 | 5 | — | 17 | 3 | 45 | ◎ | o |
| 30 | 60 | 7 | 5 | 3 | 15 | 9.5 | 0.5 | 52 | ◎ | o |
| Reference Example 1 | 60 | 5 | 9 | — | 25 | — | 1 | 16 | ◎ | o |
| 2 | 60 | 10 | 10 | — | — | 20 | — | 17 | ◎ | o |

In will be understood from Table above that in the case of the Reference Examples without containing $SnO_2$ or when a glass (No. 1) containing small amounts of $SnO_2$ is used, the resistor elements exhibit poor non-linearity coefficients, that when $SnO_2$, $SiO_2$, ZnO and $ZrO_2$ are contained in large amounts (Nos. 5, 6, 11, 21 and 28), or when PbO and $B_2O_3$ are contained in small amounts (Nos. 6, 17), the characteristics of heat cycles are deteriorated, and that when PbO or $B_2O_3$ are contained in large amounts (No. 9, 14) and when $SiO_2$ is contained in too small amounts (No. 13), the wet resistance characteristics are deteriorated. The glass exhibits excellent heat cycle characteristics and wet resistance characteristics when the requirements, i.e., $40 \leqq PbO \leqq 75\%$, $5 \leqq B_2O_3 \leqq 15\%$, and $2.5 \leqq SiO_2 \leqq 25\%$, are satisfied. Further, particularly excellent heat cycle characteristics can be exhibited when the lead borosilicate glass contains 4 to 30% of ZnO and 5 to 30% of $ZrO_2$.

EXAMPLE 3

To 785.3 g of Zno were added 15 g of $Bi_2O_3$, 4 g of $Co_2O_3$, 2.9 g of $MnCO_3$ and 15 g of $Sb_2O_3$, and were mixed and molded in the same manner as in Example 1, followed by the coating of an oxide paste and calcination to obtain a sintered element (measuring 56 mm in diameter and 20 mm in thickness). The element was then immersed in a solution consisting of 800 ml of trichlene which contains 16 g of ethyl cellulose and 600 g of a glass powder No. 30 shown in Table. After dried, the element was baked at 500° C. for 10 minutes. Both surfaces of the element were then polished and provided with electrodes. The thus prepared resistor element exhibited a non-linearity coefficient $\alpha$ of 40, and did not develop creeping flashover even when an impulse of $4\times10$ $\mu$S (peak current of 130 KA) was applied.

On the other hand, with the elements which are not coated with glass, seven elements out of ten elements developed creeping flashover when an impulse of 100 KA was applied due to the surfaces contaminated during the polishing step or during the step of attaching electrodes.

Further, when the glasses of Reference Examples 1 and 2 were coated, the resistor elements exhibited the non-linearity coefficients $\alpha$ of 18 and 19.

Relations between the thickness of the glass No. 30 and the impulse withstand voltage are shown below. Here, the element has a diameter of 56 mm, and the impulse has a wave form of $4\times10$ $\mu$S.

| Thickness of glass | Impulse withstand voltage | Note |
|---|---|---|
| 10 $\mu$m | 40 KA | |
| 30 $\mu$m | 100 KA | |
| 100 $\mu$m | 130 KA | |
| 300 $\mu$m | 120 KA | |
| 1000 $\mu$m | 100 KA | |
| 1500 $\mu$m | 60 KA | Cracks developed in the glass |

Figure 3:
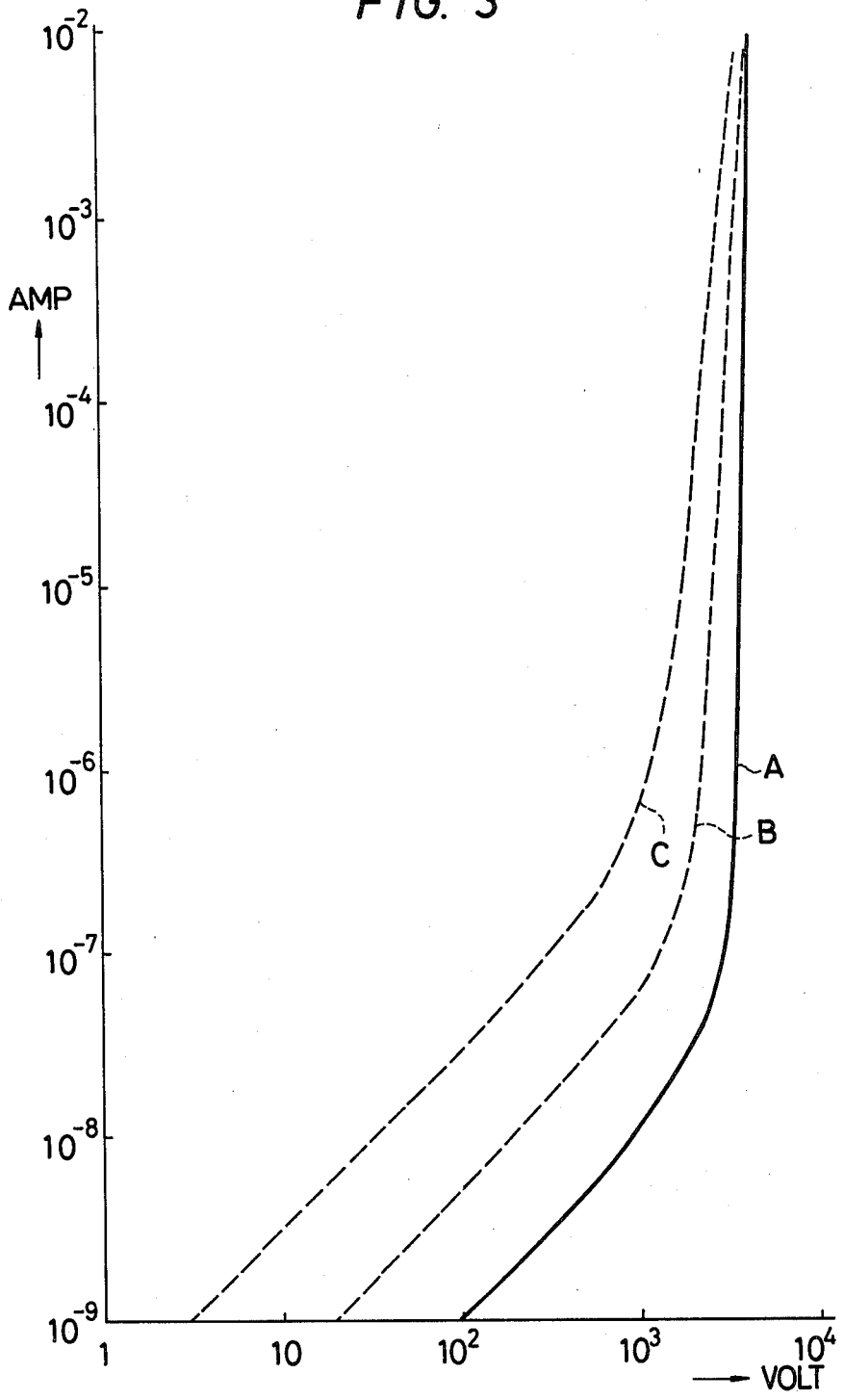
FIG. 3 is a diagram of V-I characteristics showing the relation between the conventional potentially non-linear resister and those according to the present invention.

FIG. 3 is a diagram of voltage-to-current characteristics for the potentially non-linear resistor having a diameter of 56 mm and a thickness of 22 mm. The abscissa and ordinate have logarithmic scales. In FIG. 3, a curve A represents the characteristics when the resistor is coated with the glass No. 30 shown in FIGS. 1 and 2, and a curve C represents the voltage-to-current characteristics of a potentially non-linear resistor of a diameter of 56 mm and a thickness of 22 mm as shown in FIG. 1 when the glass of a conventional composition is coated. A curve B represents the voltage-to-current characteristics of the potentially non-linear resistor having the same size as that of A and C and constructed as shown in FIG. 2, but using the glass of the conventional composition.

EXAMPLE 4

785.3 Grams of ZnO, 23.3 g of $Bi_2O_3$, 8.3 g of $Co_2O_3$ and 5.8 g of $MnCO_3$ were mixed together, granulated and molded in the same manner as in Example 3. The molded product was then calcined, coated with the glass, and was baked in the same manner as in Example 3 to obtain an element of the construction as shown in FIG. 1. The non-linearity coefficient $\alpha$ was 40 when the glass No. 30 was used, and the impulse withstand quantity was 100 KA. When a larger impulse current was allowed to flow, the interface between the sintered product 1 and the glass layer 3 developed flashover. When the glass of Reference Example 1 was used, on the other hand, the non-linearity coefficient $\alpha$ was 9. In these cases, since the glass layer was in direct contact with the sintered product, the non-linearity coefficient $\alpha$ was greatly affected by the glass composition during the step of baking.

EXAMPLE 5

485 Grams of ZnO, 10.0 g of $Nd_2O_3$ or $Sm_2O_3$ and 5.0 g of $Co_2O_3$ were mixed, granulated, molded and calcined in the same manner as in Example 4. Then, a paste containing the glass No. 30 of Table was coated on the molded product and was baked. The non-linearity coefficient $\alpha$ of the resulting elements was 25 when $Nd_2O_3$ was used and 23 when $Sm_2O_3$ was used. The impulse withstand quantity was greater than 10 times that of the element without coated with glass. The non-linearity coefficients $\alpha$ of the elements were 7 and 6, respectively, when the glass of Reference Example 1 was used.

EXAMPLE 6

A glass paste composed of a glass powder (69.8% of PbO, 8.59% of $B_2O_3$, 2.62% of $SiO_2$, 1.7% of $SnO_2$, 20.0% of ZnO, 0.25% of $ZrO_2$ and 0.04% of $Al_2O_3$), ethyl cellulose, butyl carbitol and butyl acetate, was coated on the side surface of an element that was mixed, molded, coated with the oxide paste, and calcined in the same manner as in Example 1, and was treated with heat at 425° to 550° C. for 30 minutes to form a glass layer. The glass was crystallized when heated at a temperature of 475° C. or higher. The non-linearity coefficient of the specimens was 48 to 56 when the temperature for baking the glass was 425° to 475° C., and 42 to 48 when the temperature for baking the glass was 475° to 550° C. The specimens exhibited excellent wet resistance characteristics and heat cycle characteristics. The heat cycle characteristics were particularly excellent when the glass was baked at 475° to 550° C.

The impulse withstand quantity was 100 KA when the glass layer was baked at 425° to 475° C., and 150 KA when the glass layer was baked at 475° to 550° C.

The following Table shows the data when the ratio of $SiO_2$ to $Sb_2O_3$ which constitute the high-resistance layer was changed. The glass layer, however, was baked at 500° C.

| High-resistance layer | | | Impulse withstand quantity | |
|---|---|---|---|---|
| Weight ratio of $Zn_7Sb_2O_{12}$ to $Zn_2SiO_4$ | Thickness | Thickness of glass layer | Immediately after glass was baked | After heat cycle |
| 0.4 | 50 $\mu$m | 200 $\mu$m | 108 KA | 60 KA |
| 1.0 | " | " | 152 | 151 |
| 4.0 | " | " | 150 | 150 |
| 16.0 | " | " | 156 | 155 |
| 40.1 | " | " | 153 | 72 |
| 1.11 | 3 $\mu$m | " | 102 | 100 |
| " | 10 | " | 148 | 150 |
| " | 30 | " | 155 | 157 |
| " | 200 | " | 150 | 140 |
| " | 500 | " | 132 | 58 |
| " | 50 | 10 $\mu$m | 77 | 78 |
| " | " | 30 | 150 | 150 |
| " | " | 150 | 158 | 155 |
| " | " | 300 | 153 | 150 |
| " | " | 500 | 152 | 143 |
| " | " | 1500 | 80 | 60 |

For the arresters of smaller than 288 KV, the impulse withstand quantity must be greater than 100 KA, and for the arresters of greater than 420 KV, the impulse withstand quantity must be greater than 150 KA.

When the weight ratio of zinc antimonate to zinc silicate in the high-resistance layer falls outside the range of 1 to 16, the difference between the coefficient of thermal expansion of ZnO sintered product and the coefficient of thermal expansion of high-resistance layer, presents cracks between the ZnO sintered product and the high-resistance layer during the heat cycle. This is a cause of decrease in the insulation withstand quantity. If the high-resistance layer is too thin, its effects are not sufficiently exhibited, and the adhesion strength in the interface between the ZnO sintered product and the glass layer does not become sufficiently great. Further, the high-resistance layer having too great thickness tends to become brittle under the heat cycle. According to the present invention, the high-resistance layer should preferably range from 10 to 200 μm.

EXAMPLE 7

Experiments were conducted using a glass consisting of 69.8% of PbO, 8.59% of $B_2O_3$, 2.62% of $SiO_2$, 1.00% of $SnO_2$, 20.0% of ZnO, 0.25% of $ZrO_2$, and 0.74% of $Al_2O_3$, instead of using the glass of Example 6. When the glass was baked at 425° to 475° C., the element exhibited the non-linearity coefficient $\alpha$ of 43 to 50, and excellent wet resistance characteristics as well as heat cycle characteristics.

As will be obvious from the aforementioned Examples, the potentially non-linear resistors of the type of zinc oxide of the present invention present the following advantages.

(a) The non-linearity coefficient $\alpha$ is greater by two or more times than that of the elements coated with the conventional glass which does not contain tin oxide. With the conventional elements, the non-linearity coefficient $\alpha$ is smaller than 20.

(b) The impulse withstand quantity is as great as 100 to 150 KA, which is more than two folds that of the elements which are not coated with the glass.

(c) The surface of the glass layer is smooth and is less contaminated.

(d) The resistance element exhibits excellent wet resistance characteristics and heat cycle characteristics.

What is claimed is:

1. A potentially non-linear resistor comprising a sintered product formed chiefly of a zine oxide sintered body, the side surfaces of said product being provided with a glass layer and the end surfaces of said product being provided with electrodes, wherein said glass layer comprises a lead borosilicate glass that further contains tin oxide in an amount of 0.4 to 10% by weight.

2. A potentially non-linear resistor as set forth in claim 1, wherein a high-resistance layer comprised of zinc antimonate and zinc silicate is provided on a side surface of said sintered body, and said glass layer is coated on said high-resistance layer.

3. A potentially non-linear resistor as set forth in claim 1, wherein said glass layer has a thickness of 30 μm to 1 mm.

4. A potentially non-linear resistor as set forth in claim 1, wherein said lead borosilicate glass comprises 40 to 85% by weight of lead oxide, 3 to 25% by weight of boron oxide, and 1.5 to 25% by weight of silicon oxide.

5. A potentially non-linear resistor as set forth in claim 1 or claim 4, wherein the lead borosilicate glass further contains 4 to 30% by weight of zinc oxide.

6. A potentially non-linear resistor as set forth in claim 1 or claim 4, wherein the lead borosilicate glass further contains 5 to 30% by weight of zirconium oxide.

7. A potentially non-linear resistor as set forth in claim 2, wherein the weight ratio of said zinc antimonate to zinc silicate ranges from 1:1 to 16:1.

8. A potentially non-linear resistor as set forth in claim 2, wherein the thickness of said high-resistance layer ranges from 10 to 200 μm.

9. A potentially non-linear resistor comprising a zinc oxide sintered body, the opposite end surfaces of said body each being provided with electrodes and a side surface located between said end surfaces being coated with a glass layer, wherein said glass layer comprises a lead borosilicate glass containing tin oxide in an amount of 0.4 to 10% by weight.

10. A potentially non-linear resistor as set forth in claim 9, wherein a high-resistance layer comprising zinc antimonate and zinc silicate is provided on said side surface and said glass layer is coated on said side surface via said high-resistant layer.

11. A potentially non-linear resistor as set forth in claim 9, wherein said lead borosilicate glass comprises 40 to 85% by weight of lead oxide, 3 to 25% by weight of boron oxide and 1.5 to 25% by weight of silicon oxide.

12. A potentially non-linear resistor as set forth in claim 9, wherein the lead borosilicate glass further contains 4 to 30% by weight of zinc oxide.

13. A potentially non-linear resistor as set forth in claim 9, wherein the lead borosilicate glass further contains 5 to 30% by weight of zirconium oxide.

14. A potentially non-linear resistor as set forth in claim 10, wherein the weight ratio of said zinc antimonate to zinc silicate ranges from 1:1 to 16:1.

15. A potentially non-linear resistor as set forth in claim 10, wherein the thickness of said high-resistance layer ranges from 10 to 200 μm.

* * * * *